US011674197B2

(12) United States Patent
Vignolo et al.

(10) Patent No.: US 11,674,197 B2
(45) **Date of Patent: *Jun. 13, 2023**

(54) COMBINED CONTINUOUS CASTING AND METAL STRIP HOT-ROLLING PLANT

(71) Applicant: Danieli & C. Officine Meccaniche S.P.A., Buttrio (IT)

(72) Inventors: Luciano Vignolo, Udine (IT); Mauro Guagnelli, Udine (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 766 days.

This patent is subject to a terminal disclaimer.

(21) Appl. No.: 16/494,153

(22) PCT Filed: Mar. 15, 2018

(86) PCT No.: PCT/IB2018/051745

§ 371 (c)(1),
(2) Date: Sep. 13, 2019

(87) PCT Pub. No.: WO2018/167710

PCT Pub. Date: Sep. 20, 2018

(65) Prior Publication Data

US 2020/0071793 A1 Mar. 5, 2020

(30) Foreign Application Priority Data

Mar. 15, 2017 (IT) ..... 102017000028768

(51) Int. Cl.
*C21D 9/56* (2006.01)
*B21B 1/26* (2006.01)
*C21D 8/02* (2006.01)

(52) U.S. Cl.
CPC ..... *C21D 9/56* (2013.01); *B21B 1/26* (2013.01); *C21D 8/0205* (2013.01); *C21D 8/0226* (2013.01); *C21D 2211/001* (2013.01)

(58) Field of Classification Search
CPC ..... B21B 1/32–1/36; B21B 15/0007; B21B 2015/0057
See application file for complete search history.

(56) References Cited

U.S. PATENT DOCUMENTS 407,177 A * 7/1889 Daniels ..... B21B 45/004 72/238
5,335,713 A * 8/1994 Hoppmann ..... B21C 47/245 164/269

(Continued)

FOREIGN PATENT DOCUMENTS

CN 101678415 3/2010
CN 103608131 2/2014

(Continued)

OTHER PUBLICATIONS

Machine Translation of KR-20100078425-A (Year: 2010).*

*Primary Examiner* — Kevin E Yoon
*Assistant Examiner* — Ryan L Heckman
(74) *Attorney, Agent, or Firm* — Stetina, Brunda, Garred, and Brucker

(57) ABSTRACT

A combined continuous casting and endless rolling plant for a metal strip, comprising—a continuous casting line (1) for casting a slab;—a first rolling mill (6) for roughing the slab and for obtaining a transfer bar;—a second rolling mill (11) for finishing the transfer bar and for obtaining a strip;—a third rolling mill (18), comprising at least two first rolling stands (17), for further reducing the thickness of the strip;—accumulation means (20) of the strip, downstream of said third rolling mill (18), comprising at least one first high-capacity reel (37, 37') dimensioned to wind and unwind a coil weighing from 80 to 250 tons and/or up to 6 meters in diameter, named mega coil;—flying cutting means (13), arranged between said third rolling mill (18) and said accumulation means (20), configured to cut the strip after the (Continued)

mega roll has been wound on the at least one first reel (37, 37');—a cutting and winding line (22), downstream of said accumulation means (20), for cutting the strip of the mega coil and winding portions of said strip of the mega coil to a predetermined weight limit or coil diameter limit, producing a plurality of coils; wherein said cutting and winding line (22) is provided with a reversible rolling mill for performing at least one rolling of the strip before producing said plurality of coils.

20 Claims, 6 Drawing Sheets

(56) References Cited

U.S. PATENT DOCUMENTS

| | | | | | |
|---|---|---|---|---|---|
| 5,433,264 | A * | 7/1995 | Dorigo | B21B 1/34 | 72/200 |
| 5,956,990 | A * | 9/1999 | Ginzburg | B21C 47/04 | 242/527.5 |
| 6,062,055 | A * | 5/2000 | Bobig | B21B 1/466 | 72/200 |
| 6,616,778 | B1 | 9/2003 | Bodin | | |
| 7,954,539 | B2 | 6/2011 | Benedetti et al. | | |
| 9,821,369 | B2 | 11/2017 | Benedetti et al. | | |
| 2002/0078729 | A1* | 6/2002 | Bunten | B21B 37/165 | 72/241.2 |
| 2011/0289993 | A1* | 12/2011 | Gruss | B21B 37/26 | 72/7.1 |
| 2014/0034264 | A1 | 2/2014 | Benedetti et al. | | |
| 2015/0258592 | A1* | 9/2015 | Burger | B21B 13/22 | 72/227 |

FOREIGN PATENT DOCUMENTS

| | | | | | |
|---|---|---|---|---|---|
| DE | 102015210863 | | 10/2016 | | |
| EP | 0980723 | A2 | 2/2000 | | |
| KR | 20010032852 | | 4/2001 | | |
| KR | 20100078425 | A * | 7/2010 | B21B 1/36 | |
| WO | WO0010741 | A1 | 3/2000 | | |
| WO | WO2007073841 | A1 | 7/2007 | | |
| WO | 2011080300 | A1 | 7/2011 | | |
| WO | 2016055972 | A1 | 4/2016 | | |

* cited by examiner

COMBINED CONTINUOUS CASTING AND METAL STRIP HOT-ROLLING PLANT

CROSS REFERENCE TO RELATED APPLICATION(S)

The present application claims priority to PCT International Application No. PCT/IB2018/051745 filed on Mar. 15, 2018, which application claims priority to Italian Patent Application Nos. 102017000028768 filed Mar. 15, 2017, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a combined continuous casting and metal strip hot-rolling plant in austenitic range or in ferritic range, able to produce rolled strips in the form of coils.

PRIOR ART

The development of thin slab continuous casting plant technology has led to a remarkable development of combined plants in which casting is coupled with hot rolling. An example of such plants is described in document EP0980723A2.

In relation to the arrangement of the plant and to the installed auxiliary plants, three types of rolling plants and methods are known in the prior art, characterized by different dimensional and metallurgical performance (the latter meaning the product which can be obtained at the plant outlet), namely:

- Coil to coil, in which the continuous casted slab is cut into slab pieces to a size such that a coil of strip of the desired size wound on a winding reel is obtained for each slab piece at the end of the rolling process;
- Semi-endless, in which the continuous casted slab is cut into slab pieces to a size such that a length of strip corresponding to multiple coils of the desired size, e.g. from 3 to 7 coils, is obtained for each slab piece at the end of the rolling process; flying shears being successively used to obtain coils of desired size wound on the winding reels.
- Endless, in which the continuous casted slab seamlessly crosses the rolling mills, flying shears being successively used to obtain the coils of strip of desired size wound on the winding reels.

In order to overcome the limitations of each of the previous configurations, a system was made and configured to be able to produce according to the three methods described above, in order to increase production flexibility and maximize the benefits which can be obtained by each production method.

Despite the development of the art, limitations which prevent completely replacing cold-rolled products with hot-rolled products, in the case of low-carbon steels, still remain. This means that, in order to obtain high quality products, low-carbon steel slabs must be cold-rolled, and therefore it is not possible hot-rolling only, immediately after the continuous casting. This implies that in the prior art, once the product has concluded the step of hot-rolling, it must be pickled to remove residual scaling, and then cold-rolled. Annealing treatments and possible further tempering rollings follow to finalize the surface, i.e. cold-rolling to impart the desired roughness on the product surface, remove instability at the passage from elastic to plastic behavior and to improve strip planarity. Finally, the product is coated, e.g. by means of zinc or tin, and possibly painted (FIG. 7). Between one step and the next, the product, which is wound at the end of each treatment, may remain stationary in the warehouse for even several days. About two months may elapse from when the slab is cast to when the strip is ready for sale. So, disadvantageously two dedicated rolling lines are needed, one for hot rolling and another one for cold rolling, and the product processing completion time is very long.

Moreover, while the dimensional constraints are no longer a limit because minimum thicknesses of the order of 0.6-0.8 mm can be obtained, with tolerances comparable to those of a cold-rolled strip, the limit related to the mechanical properties remains.

Disadvantageously, from a dimensional point of view, the possibility of cutting and winding strips thinner than 0.6-0.8 mm is also extremely complex because of the high risk of jamming while handling the head and leading it in, with the consequent blocking of the entire casting and rolling process.

In addition, when rolling in austenitic range, there is a limit related to the mechanical properties. This limiting constraint is related to the deformation anisotropy coefficient "r", which is much lower than that usually achieved by annealing after cold rolling, as a consequence of the different textures which develop. Additionally, as the final thickness decreases, there is a refinement of the microstructure, which leads to an increase of strength and reduction of ductility. This limits the use of hot-rolled strips to bending uses only, and in general to uses with very low deformations during moulding. Consequently, the possibility of replacing cold-rolled products with hot-rolled products is limited by the above said problems.

Finally, the current range of Advanced High Strength Steel (AHSS) which can be obtained by known systems is limited, whereby reducing the production mix of types of steel which can be obtained with these plants.

The need to provide an innovative combined continuous casting and metal strip hot-rolling plant capable of overcoming the aforesaid drawbacks is therefore felt.

SUMMARY OF THE INVENTION

It is the primary object of the present invention to provide a combined continuous casting and metal strip hot-rolling plant which makes it possible to roll a wider range of products, and to obtain output thicknesses even thinner than 0.8 mm, whereby avoiding the difficulties of handling thin strips with respect to the solutions of the prior art.

It is another object of the invention to provide a plant which allows the continuous hot-rolling also of products which according to the prior art must be cold-rolled in order to obtain good mechanical properties, whereby dramatically reducing the processing cost and the crossing time through the entire plant for new products which, after hot-rolling, can replace those made using cold-rolling cycles.

The present invention thus aims at reaching the objects discussed above by means of a combined continuous casting and metal strip endless rolling plant which comprises:

- a continuous casting line for casting a slab;
- a first rolling mill for roughing the slab and for obtaining a transfer bar;

a second rolling mill for finishing the transfer bar and for obtaining a strip;

a third rolling mill, comprising at least two first rolling stands, for further reducing the thickness of the strip;

accumulation means of the strip, downstream of said third rolling mill, comprising at least one first high-capacity reel, sized to wind and unwind a coil weighing from 80 to 250 metric tons and/or up to 6 meters in diameter, named mega coil;

cutting means, arranged between said third rolling mill and said accumulation means, configured to cut the strip after the mega coil has been wound on the at least one first reel;

a cutting and winding line, downstream of said accumulation means, for cutting the strip of the mega coil and winding portions of said strip of the mega coil up to a predetermined weight limit or coil diameter limit, producing a plurality of coils;

wherein said cutting and winding line is provided with a reversible rolling mill for performing at least one rolling of the strip before producing said plurality of coils.

A second aspect of the present invention provides a continuous casting and endless rolling process of metal strip, performed by means of the aforesaid plant, which comprises the following steps:

a) casting a slab by means of the continuous casting line;

b) roughing the slab to obtain a transfer bar by means of the first rolling mill;

c) finishing the transfer bar to obtain a strip by means of the second rolling mill;

d) further reducing the thickness of the strip by means of the at least two rolling stands of the third rolling mill;

e) winding the strip, by means of the at least one first high-capacity reel of the accumulation means, to form a coil weighing from 80 to 250 metric tons and/or up to 6 meters in diameter, named mega coil;

f) cutting the strip by means of the cutting means, after the mega coil has been wound on the at least one first reel;

g) unwinding the strip from the at least one first reel and performing at least one first rolling step of the strip in the reversible rolling mill;

h) cutting the strip and winding the portions of said strip up to a predetermined weight limit or coil diameter limit, producing a plurality of coils.

In this description, mega coil means a coil of strip, weighing from 80 to 250 metric tons and/or of up to 6 meters in diameter, preferably from 3 to 6 meters.

Advantageously, by applying the mega coil winding concept according to the invention, the risk of jamming due to the introduction of strips with portions thinner than 0.8 mm, preferably thinner than 0.7 mm, is null, despite the fast rate of advancement of the strip. Indeed, in an endless rolling mill with casting process associated with the hot-rolling process, it is the casting speed to determine the output speed of the strip from the hot rolling mill. For example, with a 110 mm thick slab and a casting speed of 6 m/min, the output speed of the finishing mill is equal to 660 m/min in order to obtain a 1.0 mm thick strip. By further reducing the thickness of the output strip, e.g. to 0.5 mm, the speed of the strip reaches 1320 m/min. So, by halving the desired strip thickness, the winding speed of the strip at the outlet of the rolling mills must also be doubled. With such advancement and winding speeds, controlling the head of the strip, cut on the fly, to avoid jamming is practically impossible with ordinary guiding devices. Therefore, providing high-capacity accumulation means for winding mega coils in the plant of the invention is extremely advantageous in order to increase continuous rolling process reliability.

A further advantage is in that a much more compact and versatile line can be obtained, which makes it possible to simplify the process of the prior art (FIG. 7), whereby reducing the product processing completion time, which may pass from about two months to one month. In particular, once having have crossed the single rolling layout of the plant of the invention comprising the three hot-rolling mills, in order to be made ready for selling, the strip only needs to be successively pickled, and possibly surface-worked by tempering rolling, coated and/or pre-painted (FIG. 8). Indeed, all the remaining heat and rolling treatments are performed aboard the single rolling layout. This makes it possible to shorten the time between product casting and its finalization in view of sales, which becomes less than a month.

Additionally, by means of the layout which is object of the present invention, DQ (Drawing Quality), DDQ (Deep-Drawing Quality) and EDDQ (Extra Deep-Drawing Quality) products, which are currently made exclusively on cold-rolling plants, can be made and have properties at least equal to those made with the plants of the prior art.

Advantageously, the plant of the invention provides a third rolling mill with at least two further rolling stands downstream of the finishing mill, which further rolling stands make it possible to further reduce the thickness of the strip and may be preceded, in a variant of the invention, by a rapid heating device or by a rapid cooling device, according to whether it is desired to work in austenitic range or in ferritic range.

A further rapid heating device may be provided upstream of the finishing mill in order to keep the rolling in austenitic range.

When a product is rolled with these two additional rolling stands, to make it thinner than 0.8 mm, the need to manage this product during the cutting and the rolling arises. Indeed, the strip is not sent directly to the conventional winding reels, suitable for winding strip with a thickness of at least 1 mm, but after being cooled by the laminar cooling line, it is sent to an accumulation station of the mega coil type, which in turn sends it to a warm rolling mill with final winding reels upstream and downstream of the reversible rolling mill.

The weights of the final coils on the final winding reels are fixed on automation level, by setting a weight limit and optionally a diameter limit. The first of the two limits to be reached by the final coils, detected by means of weight and/or diameter sensors, starts the cutting using shears.

In a preferred embodiment of the plant of the invention, the mega coil type accumulation station is coupled to a cutting and winding line also comprising a reversible rolling mill with at least two rolling stands, e.g. only two, designed to obtain the rolling process known as "warm rolling". This warm rolling mill receives material at temperature from 200 to 600° C., with inlet thickness from 0.5 to 5 mm and rolls it to outlet thickness from 0.25 to 2.0 mm. In particular, thicknesses from 0.25 to 2.0 mm for low-carbon steel strips and thicknesses from 0.5 to 1.5 mm for HSS strips can be obtained.

At least one reel and respective cutting means are provided upstream and downstream of the reversible rolling mill. At the end of the last rolling step, either even or odd, portions or stretches of strip, optionally of different thickness and weight, are separated by means of the respective cutting means and the corresponding coils of strip, with specific weight from 10 to 20 kg/mm and weight up to 35 metric tons, preferably from 15 to 35 metric tons, are wound onto the adjacent reel. For example, from 5 to 8 coils, optionally of different thicknesses and weight, can be obtained from one mega coil.

As known, specific weight is a method used in the steel industry to define the weight of the coils processed by the plants. For instance, 18 kg/mm means that in order to calculate the weight (kg) of the coil it will suffice to multiply the width (mm) of the strip by the specific weight (kg/mm).

The number of reversible rolling steps is variable according to the desired final thickness. At least two high-capacity reels are provided for the reversible rolling of the mega coil, arranged one upstream and one downstream of the reversible rolling mill and adapted to wind and unwind the entire mega coil.

In the case of stretches of strip forming the mega coil having different thickness, the rolling stands of the third rolling mill are programed to roll to a specific thickness, which may be either equal for all stretches of strip or different according to the final production requirements and to the desired thickness of the production batch.

The working method provides that when an ultra-thin strip campaign is started, a strip of a thickness such as to minimize the risks of jamming is firstly rolled, e.g. thicker than or equal to 1 mm, which will initially be wound on conventional winding systems.

When it is desired to start reducing the thickness to less than 1 mm and to obtain stretches of strip of different thickness, the strip is cut by means of a flying cutting shear; the tail of cut strip is wrapped around the coil already wound on the conventional reel, while the head of the strip obtained by cutting is routed toward the accumulation means comprising two reels for mega coils, for example. The winding on one of these mega coil reels is promoted by a belt wrapper which promotes the winding of the first turns. Once the winding reel has tensioned the strip, the wrapper opens and gradually the stands of the third rolling mill begin to roll at different thicknesses, whereby producing stretches of strip of decreasing and then increasing thickness with respect to an initial thickness of at least 1 mm, which are seamlessly wound on the mega coil winding reel.

Advantageously, any deviation of the strip from the center line of the plant may be measured by appropriate optical sensors and a centering system moves the mega coil winding reel which is mounted on slides to allow this movement with low friction, the movement being controlled by hydraulic actuator.

The dependent claims describe preferred embodiments of the invention.

BRIEF DESCRIPTION OF THE FIGURES

Further features and advantages of the present invention will be more apparent in light of the detailed description of a preferred, but not exclusive, embodiment, of a combined continuous casting and metal strip rolling plant illustrated by way of non-limiting example, with the aid of the accompanying drawings, in which.

The same reference numbers in the figures identify the same elements or components.

DETAILED DESCRIPTION OF PREFERRED EMBODIMENTS OF THE INVENTION

Figure 1:
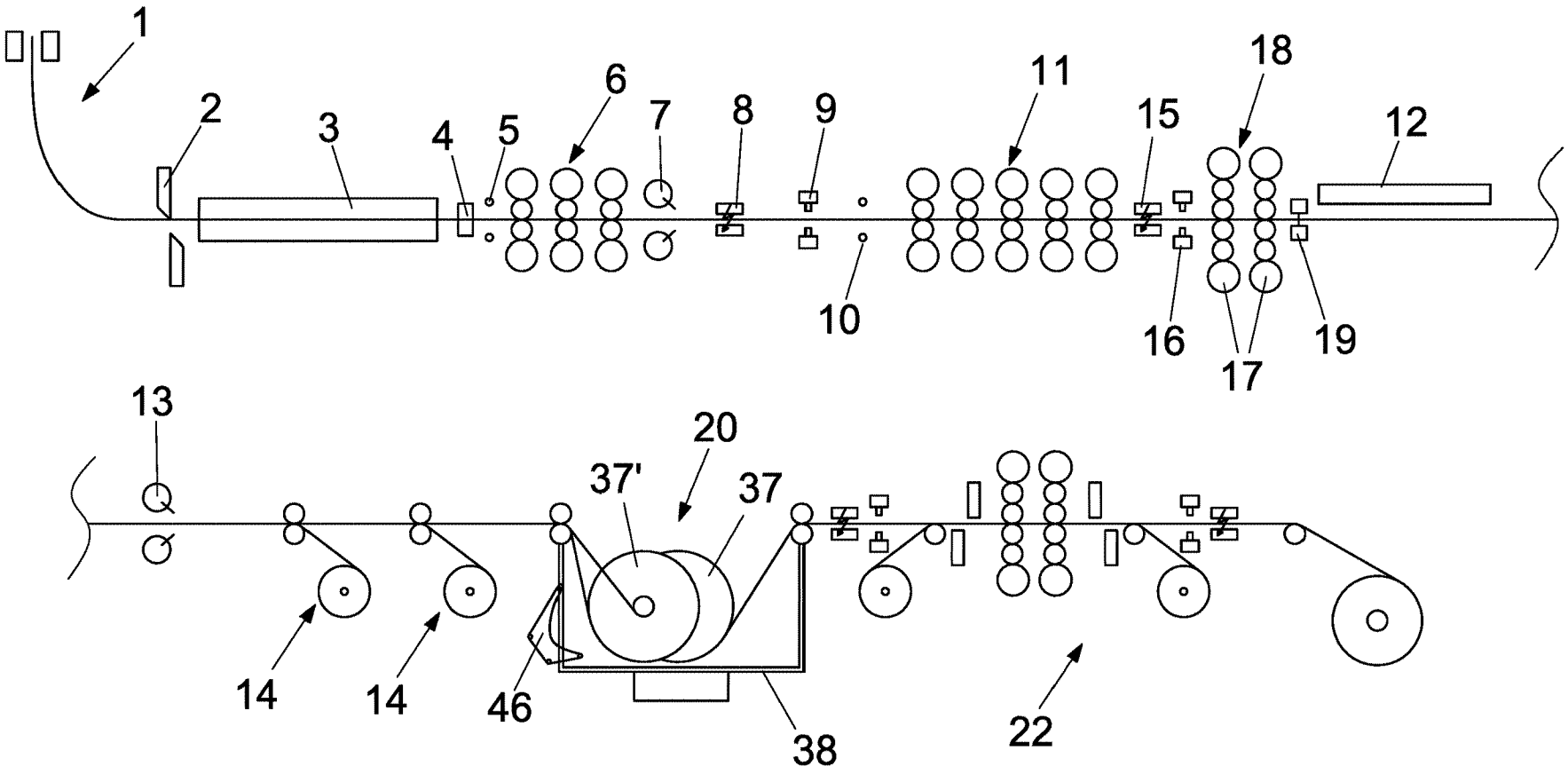
FIG. 1 is a diagrammatic view of an embodiment of a plant according to the invention.

FIGS. from 1 to 6 show preferred embodiments of a combined plant of continuous casting and rolling of thin slab to obtain a strip in endless mode to obtain coils of strip. The material of the strip is preferably steel.

The plant, which is object of the present invention, in all its embodiments, comprises in succession:

- a continuous casting machine 1 for casting a slab, preferably a slab having a thickness comprised between 30 and 140 mm;
- a first rolling mill 6 or roughing mill, preferably comprising one to four rolling stands, in order to perform a hot roughing of the slab and to obtain a blank, i.e. the so-called transfer bar;
- a second rolling mill 11 or finishing mill, preferably comprising from three to seven rolling stands, in order to perform a hot finishing of the transfer bar and to obtain a strip;
- a third rolling mill 18, comprising at least two rolling stands 17, for further reducing the thickness of the strip; said at least two rolling stands 17 being preferably four-high stands or even more preferably six-high stands;
- accumulation means 20 of the strip comprising at least one first high-capacity reel 37, 37', dimensioned to wind and unwind a coil weighing from 80 to 250 metric tons and/or up to 6 meters, preferably from 3 to 6 meters, in diameter, named mega coil;
- and a cutting and winding line 22 at least provided with a reversible rolling mill;
- at least one reel 27 and at least one reel 26, respectively provided downstream and upstream of the rolling mill, for winding portions of strip up to a predetermined weight limit or coil diameter limit;
- cutting means 29, 29', arranged respectively between said accumulation means 20 and said at least one reel 27 and between said accumulation means 20 and said at least one reel 26, adapted to cut the strip whenever a portion of strip wound on the at least one reel 27, 26 reaches said predetermined weight limit or coil diameter limit;
- a further high-capacity reel 25, sized to wind and unwind a mega coil, arranged downstream of the at least one reel 27.

Weight and/or diameter sensors of the coil being wound on at least on reel 27, 26 are provided to send a command signal to the cutting means 29, 29' whenever a portion of strip wound on the at least one reel 27, 26 reaches said predetermined coil weight limit or coil diameter limit.

Advantageously, providing the third rolling mill 18 and the particular accumulation means 20 make it possible to obtain products, possibly of different thickness and quality, even very thin, while avoiding the risk of jamming deriving from the process.

In a preferred variant, common to all the embodiments of the plant of the invention, the accumulation means 20 comprise two high-capacity reels 37, 37' integral with a rotatable platform 38, e.g. fixed to opposite ends of the rotatable platform. This platform 38 may rotate, e.g. by 180°, about a vertical axis after a predetermined period of time during which a mega coil is wound on one of the two reels 37, 37', so that alternatively reel 37 is used as the winding reel of continuous strip coming from the third rolling mill 18 and reel 37' is used as the unwinding reel of continuous strip for feeding it towards said reversible rolling mill.

A metal belt wrapper 46, which winds around the reel 37 or 37 ready to receive the head of hot-rolled strip to obtain a mega coil, is advantageously provided.

Cutting means 13 are provided upstream of the rotatable platform 38, configured to cut the strip once a coil of weight from 80 to 250 metric tons and/or diameter up to 6 meters, preferably from 3 to 6 meters, has been wound on one of the two reels 37, 37'. Further weight and/or diameter sensors of the coil being wound on one of the two reels 37, 37' are provided to send a command signal to the cutting means 13 whenever a reel weighing from 80 to 250 tons and/or of diameter up to 6 meters is wound on one of the two reels 37, 37'. The 180° rotation of the rotatable platform 38 takes place after this cut. These cutting means 13 preferably consist of flying cutting shears, for example sized to cut on the fly at advancement speeds of the strip of up to about 25 m/s. The cutting means 29, 29' preferably consist of static shears, instead.

The rotatable platform 38, defining a dual winding/unwinding system of the strip, can be driven by means of, for example, a rack system. Its rotation is controlled by a control unit, constituted for example by an electric or hydraulic motor 45, a gearbox and a pinion which meshes with the rack mounted on the rotatable platform 38.

The rotation controls 44, 43 and 41, 40 of the respective reels 37, 37 are mutually independent so as to independently control the winding rotation of the strip coming from the third rolling mill 18 and the unwinding rotation of the strip towards said at least one reversible rolling mill.

During the 180° rotation of the rotatable platform 38, the rotation controls 44, 43 and 41, 40 are uncoupled from the respective reels 37, 37 by means of a respective movable joint 39, 42, which is retracted.

The strip wound and unwound on the reels 37, 37' is kept aligned and centered by means of an axial movement of a respective mandrel 34, 34 controlled by a corresponding hydraulic cylinder 33, 33'.

Furthermore, again in common to all the embodiments of the invention, the following are provided in succession downstream of the continuous casting machine 1:

- optional shears 2, for example oscillating shears for cutting the slab in cases of emergency;
- an optional tunnel furnace 3, for maintaining or equalizing or increasing the temperature of the slab;
- at least one optional vertical rolling stand 4 (edger), or at least one optional press, to reduce the width of the slab and bring it closer to that of the strip which is desired to be obtained, in order to reduce waste and improve yield;
- an optional first descaling device 5, immediately upstream of the roughing mill 6;
- optional shears 7 for cutting the transfer bar in cases of emergency or to eliminate the ends which may have an irregular shape, whereby avoiding damage to the working rolls of the finishing mill 11 and reducing the likelihood of jamming with consequent generation of waste;
- an optional rapid heating device 8, e.g. an induction heating device, the power of which can be modulated and appropriately activated to restore the temperature that the product loses during roughing and to thus enter into the finishing mill remaining in austenitic range;
- an optional second descaling device 10, immediately upstream of the finishing mill 11;
- an optional laminar cooling device 12, e.g. in the form of a roller table, located downstream of the at least two rolling stands 17 of the third rolling mill 18 and immediately upstream of the cutting means 13, said roller table being provided with laminar cooling systems for the upper and lower surface of the strip being rolled;
- at least two optional winding systems 14, arranged downstream of the cutting means 13, comprising, for example, pinch rollers and deflectors, winding reel, winding rolls and coil unloading system; said winding systems 14 being used for winding strips rolled to conventional thickness from 1 to 25 mm without using the two rolling stands 17 for ultra-thin thicknesses.

Advantageously, a rapid heating device 15, e.g. an induction heating device, and/or a rapid cooling device 16, e.g. a device for producing sprays or blades of cooling liquid on both the upper and lower surfaces of the strip, are provided between the finishing mill 11 and the third rolling mill 18.

The rapid heating device 15 is adapted to be activated if the rolling is kept in austenitic range also in the at least rolling stands 17, while the first rapid cooling device 16 is adapted to be activated if the rolling is changed from austenitic range to ferritic range.

Immediately downstream of the third rolling mill 18 and upstream of the laminar cooling device 12, a further rapid cooling device 19 is provided, with the purpose of reducing the temperature of the newly rolled product and achieving a refinement of the micro structure as a result of the high driving force.

Figure 2:
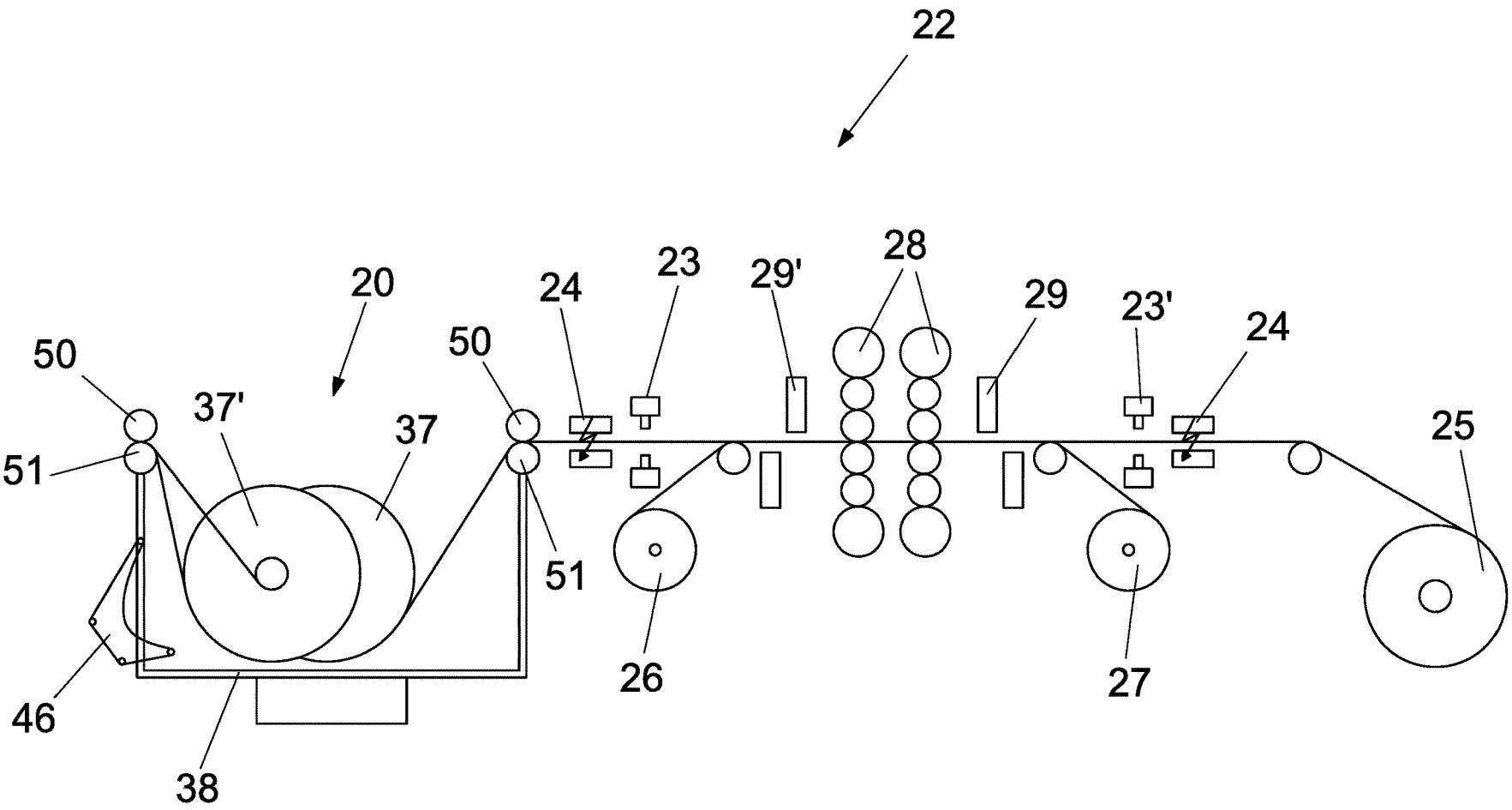
FIG. 2 is an enlarged diagrammatic view of the part of the plant in FIG. 1.

In a preferred embodiment of the invention, shown in FIGS. 1 and 2, downstream of the accumulation means 20, comprising the rotatable platform 38 and the two reels 37, 37', the cutting and winding line 22 provides the possibility of a further rolling of the ultra-thin strip.

Indeed, the cutting and winding line 22 comprises a reversible rolling mill of the warm rolling type, having at least two rolling stands 28 arranged upstream:

- of the at least one reel 27, configured to wind at least one portion of the strip after at least one odd rolling step in the reversible rolling mill up to a predetermined limit of weight or diameter of the coil, preferably up to a specific weight from 10 to 20 kg/mm, e.g. obtaining coils of up to 35 metric tons, preferably from 15 to 35 metric tons, and with a maximum diameter equal to 2.1 meters;
- of the cutting means 29, arranged between said two rolling stands 28 and the at least one reel 27 and configured to cut the strip whenever a portion of strip wound on the at least one reel 27 reaches said predetermined weight limit or coil diameter limit.
- and of a high-capacity reel 25, arranged downstream of the at least one reel 27, to wind the strip after at least one odd rolling step in the reversible rolling mill, said reel 25 being sized to wind a coil of weight from 80 to 250 metric tons and/or diameter of up to 6 meters, preferably from 3 to 6 meters, i.e. a mega coil.

Furthermore, upstream of the at least two rolling stands 28 there are provided:

at least one further reel 26, configured to wind one portion of the strip after at least one even rolling step in the reversible rolling mill in opposite sense to the odd step, said at least one further reel 26 being sized to wind portions of strip up to a predetermined limit of weight, preferably up to a specific weight from 10 to 20 kg/mm, e.g. obtaining reels of up to 35 tons, preferably from 15 to 35 tons, and with a maximum diameter equal to 2.1 meters;

cutting means 29', arranged between the at least one further reel 26 and said at least two rolling stands 28, to cut the strip whenever a portion of strip wound on the further reel 26 reaches said predetermined weight limit or coil diameter limit.

In a first variant, there are provided only one reel 27 and only one reel 26. The cutting means 29 and the cutting means 29' consist of a static cutting shear. Alternatively, at least two reels 27 and at least two reels 26, preferably only two reels 27 and only two reels 26, may be provided.

A second variant provides the use of flying cutting shears, instead of the static cutting shears, and the use of carousels of reels as an alternative to the two reels 26, 27 distinct from each other. The carousels have generally two reels each, which are diametrically opposite to one another and hinged onto a rotating drum, which alternatively wind the rolled strip: when one of the two reels is winding a final coil, the other reel is freed of the previously wound final coil.

The high-capacity reels 37, 37' and 25 are preferably made of a thick tube or of metal rod capable of supporting the weight of the coils of large size up to 250 tons of weight or 6 meters in diameter. Such reels 37, 37', 25 are also sized to apply, during rolling, a traction from 350 to 500 kN, preferably 400 kN, in order to promote high thickness reductions in the reversible rolling mill.

The reversible rolling stands 28 are preferably of the four-high or of the six-high stand type. In a variant, there are only two rolling stands 28; in other variants, there may be more than two, e.g. three rolling stands. The rolling stands 28 may be configured to apply an asymmetric rolling so as to obtain material with ultra-fine grain (UFG).

In a particular variant, there are at least two—preferably two—rolling stands 28, but a further rolling stand (not shown) may be provided downstream of the rolling stands 28 and configured to be opened in the odd rolling step and closed in the even rolling step. In this manner, two rolling steps with five reductions of thickness are performed in total. Advantageously, the further rolling stand is equipped with working cylinders having surface roughness greater than the surface roughness of the working cylinders in the rolling stands 28. This variant makes it possible to obtain a rolling surface with controlled roughness in the last rolling step. Advantageously, an inlet rapid heating device 24 and/or an outlet rapid cooling device 23, arranged at the reversible rolling mill inlet, are provided between the accumulation means 20 and the at least one reel 26, and an outlet rapid heating device 24' and/or an outlet rapid cooling device 23', arranged at the outlet of the reversible rolling mill, are provided between the at least one reel 27 and the reel 25.

Some advantageous methods of operation of this embodiment of the plant of the invention are described below (FIGS. 1-4).

In a first advantageous method of operation, rolling is provided in rolling trains 6, 11 and 18 always in austenitic range.

The process performed in this first method comprises the following steps in succession:

casting a thin slab having a thickness, e.g. comprised between 30 and 140 mm, preferably between 80 and 140 mm, by means of the continuous casting machine 1;

optionally keeping or equalizing or increasing the temperature of the slab by means of the tunnel heating furnace 3;

optionally reducing the width of the slab, and bringing it closer to that of the strip to be obtained, by means of the at least one vertical rolling stand 4, if provided;

optionally performing the descaling of the slab, before roughing, by means of the first descaling device 5;

performing the hot roughing of the slab by the roughing mill 6, producing a transfer bar, preferably of thickness of about 5-50 mm;

optionally actuating, if provided, the shears 7 for cutting the transfer bar in cases of emergency or to eliminate the ends which may have irregular shape;

optionally heating the transfer bar by means of the rapid heating device 8, e.g. induction heating device, to restore the temperature that the product lost during roughing and to thus enter into the finishing train 11 remaining in austenitic range;

optionally descaling the transfer slab, before finishing, by means of the second descaling device 10, if provided;

performing the hot finishing of the transfer slab by means of the finishing mill 11, obtaining a strip, preferably of thickness of about 1-25 mm;

optionally heating the strip by means of the rapid heating device 15 to restore the temperature that the product lost during finishing and to thus enter into the rolling mill 18 remaining in austenitic range;

further reducing the thickness of the strip, preferably to about 0.5-5 mm, by means of the third rolling train 18;

optionally cooling the strip by means of the further rapid cooling device 19, to reduce the temperature of the strip and obtain a refinement of the microstructure;

optionally cooling the strip by the laminar cooling device 12.

Figure 5:
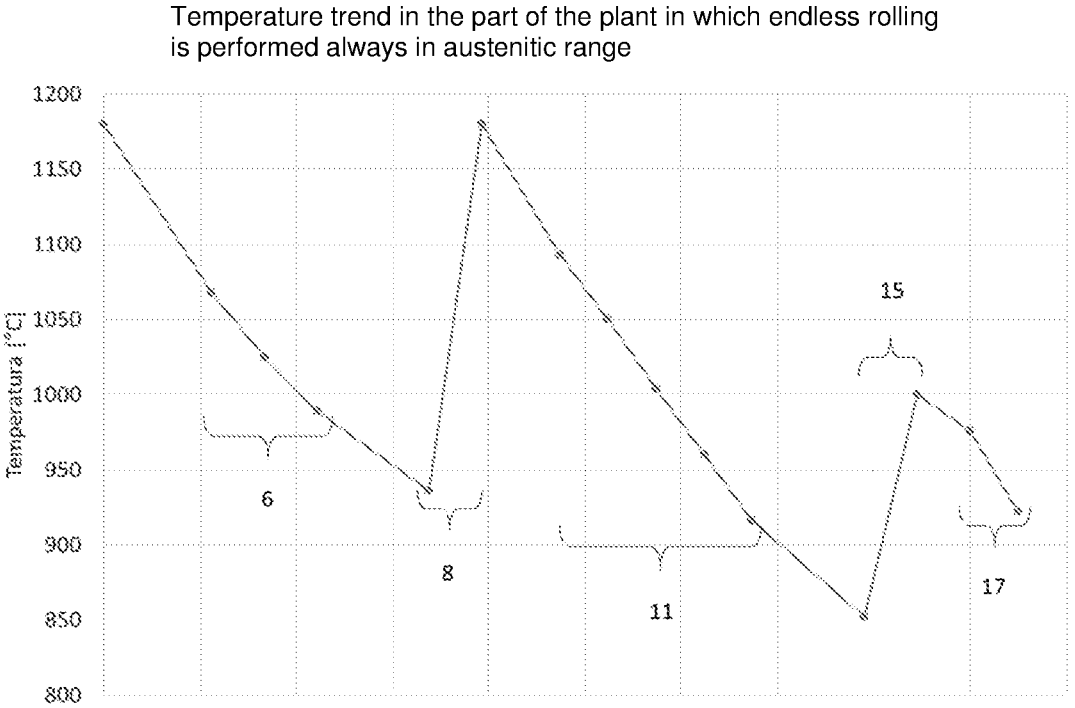
FIG. 5 is an example of the temperature trend the part of the plant in which the endless rolling is performed always in austenitic range.

In this first operating method, the strip, at the outlet of the finishing mill 11, in order to maintain an adequate temperature for the successive rolling still in austenitic range, can be heated by the rapid heating device 15, e.g. an inductor. This expedient prevents the passage of phase between finishing mill 11 and the at least two rolling stands 17. An example of the temperature trend is shown in FIG. 5, in which the numbers are referred to the components shown in FIG. 1.

The strip is rolled in at least two rolling stands 17 to achieve thicknesses thinner than 0.8 mm, e.g. thinner than 0.7 mm. Considering the fast rolling speed and the ultra-thin thickness, it is preferable for the stands 17 to be of the six-high stand type to achieve a better planarity control.

At the outlet of the at least two—preferably two—rolling stands 17, the strip may undergo an accelerated cooling by virtue of the further rapid cooling device 19. The latter makes it possible, in combination with the laminar cooling device 12, to be able to obtain AHSS steels (DP, TRIP, CP, MS) by applying appropriate cooling cycles. These steels have a minimum rolling thickness which depends upon the grade. The two stands 17, together with the inductive heating which precedes them by means of the rapid heating device 15, make it possible to reduce the minimum rolling thickness. The two stands 17 are also designed in such a way as to be able to apply an asymmetric rolling process in order to obtain the so-called deformation induced ferrite transformation (DIFT) rolling, which makes it possible to obtain steel with ultra-fine grain, and consequently high-strength strips with lean chemical composition.

Figure 3:
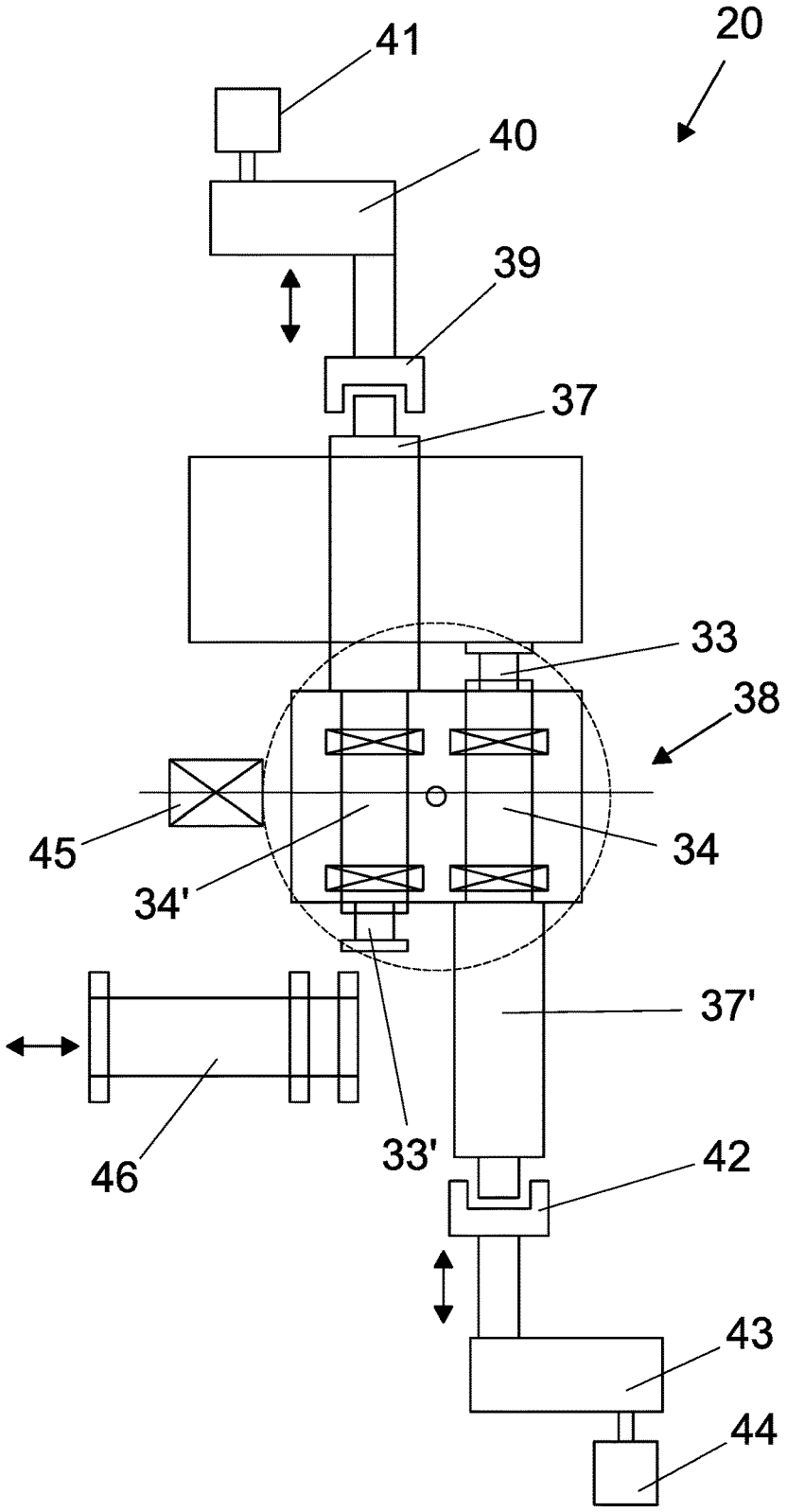
FIG. 3 is a diagrammatic view of a dual strip winding and unwinding system.

After the laminar cooling in the cooling device 12, the continuous strip enters into the accumulation means 20 and is wound, for example, on the high-capacity reel 37 of the rotatable platform 38 (FIG. 3).

Figure 4:
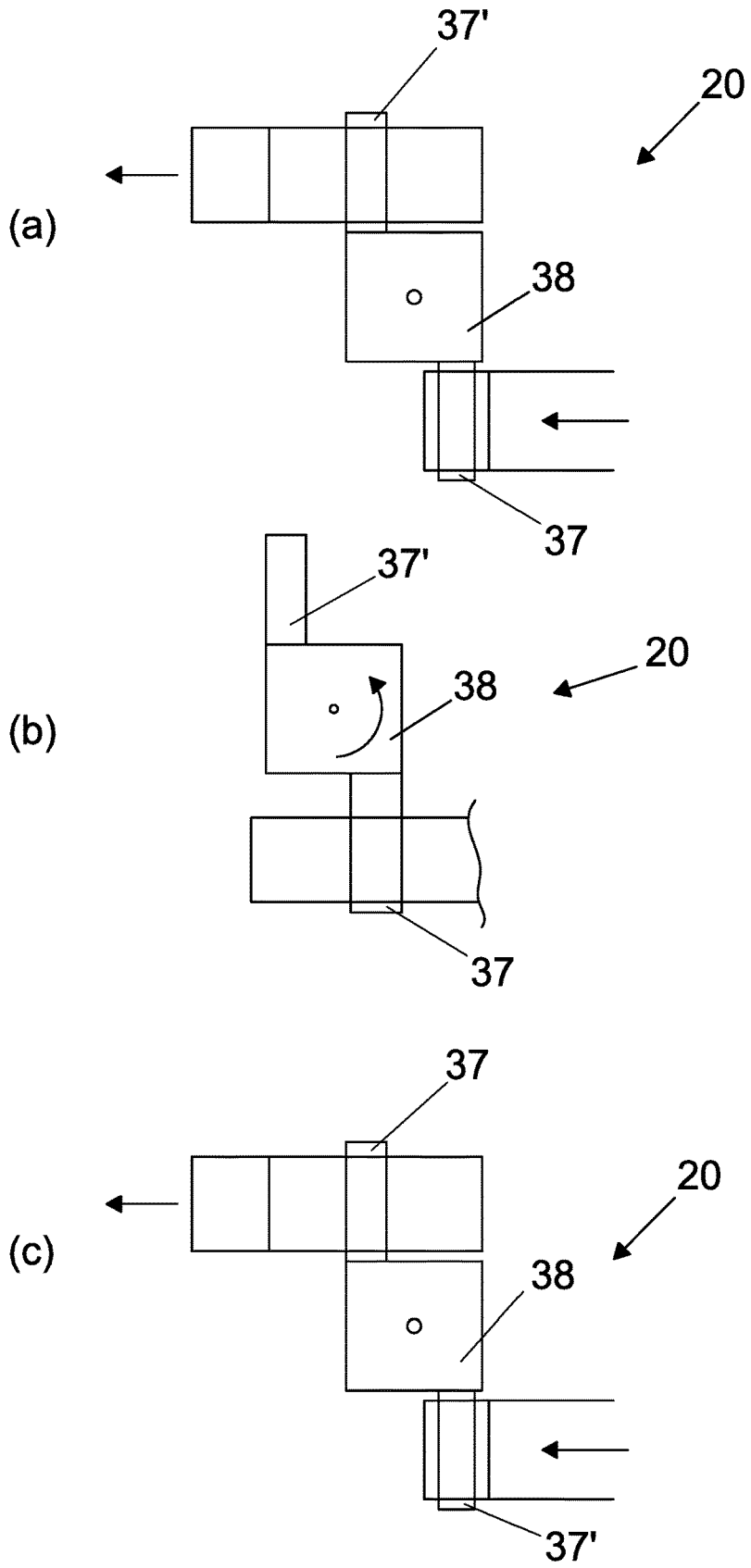
FIG. 4 is a working sequence of the aforesaid dual strip winding and unwinding system.

FIG. 4 diagrammatically shows the working sequence at full rate of the rotatable platform 38. In a first step (FIG. 4*a*), the reel 37 starts winding a mega coil of strip, while the reel 37' starts unwinding another mega coil, previously wound, toward the reversible rolling mill.

In a second step (FIG. 4*b*), while reel 37' completes the unwinding of another mega coil and remains empty, reel 37 completes the winding of the mega coil of strip, the winding is interrupted, the strip is cut upstream of the rotatable platform 38 by the cutting means 13, so that the tail of the cut strip is wound and completes the formation of the mega coil. So, the rotatable platform 38 starts turning to take said reel 37 to the unwinding position of the strip toward the reversible rolling mill.

If, upon completion of the winding of the mega coil on reel 37, reel 37' is not yet empty, the head of the strip obtained by cutting with the cutting means 13 is routed onto the winding systems 14, having adjusted the plant to produce a strip of thickness such as to be able to be conveniently wound on such systems 14. Once having completed the unwinding of the mega coil from the reel 37', the rotatable platform 38 starts turning to take the reel 37 into the unwinding position.

In a third step (FIG. 4*c*), with reel 37 in the unwinding position, the strip is unwound from the reel 37 toward the reversible rolling mill, while reel 37' begins winding a new mega coil of strip.

During the unwinding of the strip from one of the two reels 37, 37', the strip is led in through the cutting and winding line 22.

If a single rolling step (odd step) is provided in the reversible rolling mill, at the outlet of the rolling stands 28, a portion of the rolled strip is wound on the reel 27 up to form a first coil having a specific weight, preferably from 10 to 20 kg/mm, whereby obtaining coils up to 35 metric tons, preferably from 15 to 35 metric tons, and maximum diameter equal to 2.1 meters. At this point, the winding reel 37 or 37' stops, the reversible rolling mill stops, dedicated sensors send a command signal to the static cutting shears 29 which cuts the strip being wound on the reel 27 and the first coil is unloaded from said reel 27. The head of the strip obtained at the outlet of the rolling stands 28 is led onto the emptied reel 27 or onto a further reel 27 and the rolling step is resumed up to obtain a second rolled coil on the reel 27 having specific weight from 10 to 20 kg/mm. The reversible rolling mill stops again, the static cutting shears 29 cut the strip being wound on the reel 27 and the second rolled coil is unloaded from the reel 27. These operations are repeated until the rolling of a last rolled coil, e.g. the fifth coil. The rolling stops, the rolling stands 28 are opened, the static cutting shears 29 optionally cut the strip again and said second rolled coil having a specific weight from 10 to 20 kg/mm is unloaded from the reel 27. Generally, from 5 to 8 coils of strip are obtained on the reel or on the reels 27.

If more than one rolling step is provided in the reversibly rolling mill, during the first rolling step (odd), the rolling stands 28 roll continuously, to obtain the so-called mega coil, i.e. the coil of weight from 80 to 250 metric tons and diameter up to 6 meters, preferably from 3 to 6 meters, again on the reel 25. For example, during this first rolling step, the mega coil present on the winding reel 37 is completely unwound; at the same time, the other reel 37' in the winding position of the strip winds a new mega coil.

Afterwards, a second (even) rolling step is performed so that the strip is unwound by the reel 25, rolled in the rolling stands 28 and rewound to make the so-called mega coil again on the reel 37.

Continuing in this manner, the reversible rolling mill may perform successive rolling step (odd/even) to obtain the final thickness of the product.

At the end of the second-to-last rolling step the tail of the mega coil is entirely unwound from the reel 25 or from the reel 37 according to whether the final rolling step is respectively even or odd, and is introduced either on reel 26 if the later rolling step is an even step or on reel 27 if the last rolling step is an odd rolling step.

If the last rolling step is an odd step, at the outlet of the rolling stands 28 a portion of the rolled strip is wound on the reel 27 up to form a first coil having a specific weight, preferably from 10 to 20 kg/mm, whereby obtaining coils up to 35 metric tons, preferably from 15 to 35 metric tons. At this point, as described above, the winding reel 37 stops, the reversible rolling mill stops, dedicated sensors send a command signal to the static cutting shears 29 which cut the strip being wound on the reel 27 and the first reel is unloaded from said reel 27. The head of strip obtained by the cutting of the shears 29 is led onto the emptied reel 27 or onto a further reel 27, and the unwinding from the unwinding reel 37 and the odd rolling step resume until a second coil is obtained on the reel 27 having the aforesaid specific weight. The process continues with this working method until the complete unwinding of the mega coil, from which from 5 to 8 coils are obtained, onto the reel or reels 27.

If the last rolling step is an even step, at the outlet of the rolling stands 28 a portion of the rolled strip is wound on the reel 26 up to form a first coil having a specific weight, preferably from 10 to 20 kg/mm, whereby obtaining coils up to 35 metric tons, preferably from 15 to 35 metric tons, and a maximum diameter equal to 2.1 meters. At this point, the winding reel 25 stops, the reversible rolling mill stops, dedicated sensors send a command signal to the static cutting shears 29' which cut the strip being wound on the reel 26 and the first reel is unloaded from said reel 26. The head of the strip obtained at the outlet of the rolling stands 28 is led into the emptied reel 26 or onto a further reel 26 and the even rolling step is resumed to obtain a second rolled coil on the reel 26 having specific weight from 10 to 20 kg/mm. The reversible rolling mill stops again, the static cutting shears 29' cut the strip being wound on the reel 26 and the second rolled coil is unloaded from the reel 26. These operations are repeated until the rolling of a last rolled coil, e.g. the fifth coil. The rolling stops, the rolling stands 28 are opened, the static cutting shears 29' optionally cut the strip again and said last rolled coil having a specific weight from 10 to 20 kg/mm is unloaded from the reel 26. Generally, from 5 to 8 coils of strip are obtained on the reel or on the reels 26.

According to the chosen metallurgical cycle, during the various rolling runs, either the rapid heating devices 24, 24' or the rapid cooling devices 23, 23' will be activated.

In, the meantime, on the high-capacity winding reel 37', as soon as the winding of a mega coil is completed, the winding stops, the strip is cut upstream of the rotatable platform 38 by means of the cutting means 13, and said rotatable platform 38 is turned by 180° taking the reel 37' to the unwinding position towards the reversible rolling mill and the reel 37 into the winding position of the strip coming from the third rolling mill 18.

At this point, the warm rolling process and the formation of coils of continuous strip portions continues in manner similar to that described above, the strip being moved between reel 37' and reel 25.

In a second advantageous method of operation, rolling is provided in the rolling mill 18 in ferritic range, instead.

The process performed in this second method is the same as the one performed in the first method, except for the fact that the strip is cooled by the rapid cooling device 16, instead of the heating of the strip by the rapid heating device 15.

This makes it possible to go from rolling in austenitic range, as occurs both in the roughing mill 6 and in the finishing mill 11, to rolling in ferritic range in the third rolling mill 18. Furthermore, in case of passage to rolling in ferritic range the use of the further rapid cooling device 19, downstream of the rolling mill 18, is not provided.

In particular, in a first variant, the rapid heating device 15 is retracted off-line, while the rapid cooling device 16 is inserted in-line so that the strip before entering in rolling stands 17 of the rolling mill 18 is already in ferritic range at the most suitable temperatures to achieve the desired cycle. Indeed, there are several types of ferritic rolling according to whether it is desired to obtain a recrystallized microstructure after winding for direct use (deformation and winding temperature must therefore be sufficiently high) or a raw microstructure which requires an annealing process downstream to recrystallize. The difference between the different cycles, by controlling the deformation and the winding temperature consists in a different texture of the ferritic grains after recrystallization, and hence a more or less forced improvement in ductility and moldability properties (in general terms, ductility properties are promoted by a low rolling temperature).

Figure 6:
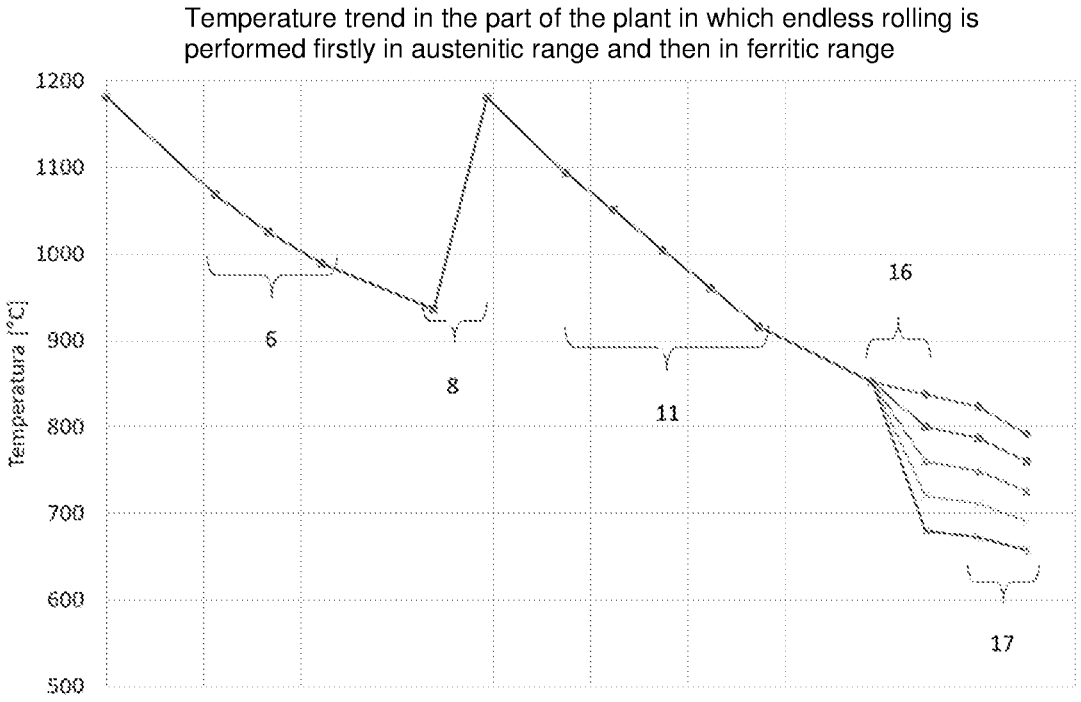
FIG. 6 is an example of the temperature trend in part of the plant in which the endless rolling is performed firstly in austenitic range and then in ferritic range.
Figure 8:
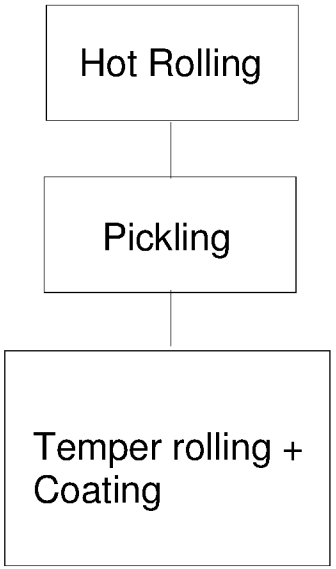
FIG. 8 is a block chart of a plant according to the invention.
Figure 7:
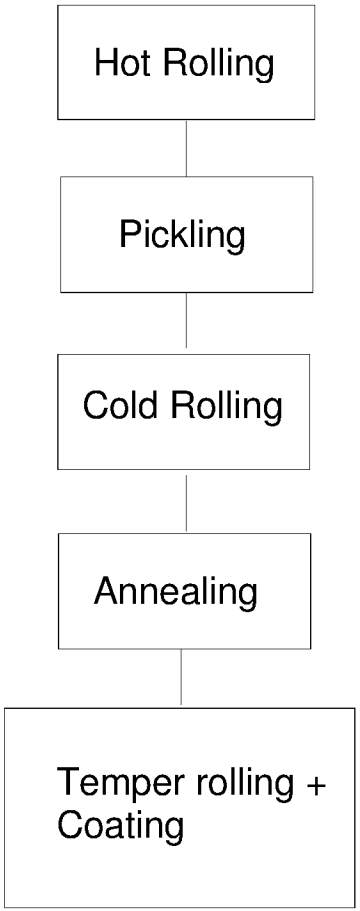
FIG. 7 is a block chart of a plant according to the prior art.

An example of the temperature trend is shown in FIG. 6, in which the numbers are referred to the components shown in FIG. 1.

Handling devices are preferably provided for alternatively inserting in-line or retracting off-line the rapid heating device 15 and the first rapid cooling device 16.

Advantageously, in all the embodiments of the plant of the invention, devices may be provided for automatically adjusting the gap between the working rolls of the at least two rolling stands 17 of the rolling mill 18 and of the at least two rolling stands 28 of the reversible rolling mill.

Said adjusting devices comprise, for example, an adjustment controller cooperating with thickness and strip speed gages, the measurements of which are used by the controller to modify the parameters of the main actuators of the rolling stands 17 and of the rolling stands 28, in particular to change speed and torque of the rotation motors of the working rolls and the position of the hydraulic capsules which control the gap between the working rolls.

These adjustment devices make it possible to produce, at the outlet of the rolling stands 17, stretches of strip of mutually different thickness, preferably but not necessarily, with initial stretches of strip with decreasing thickness from a first initial stretch to the successive one, up to a central stretch, and with final stretches of strip, successive to said central stretch, with increasing thickness with respect to the central stretch and increasing from a first end stretch to the last final stretch. A sequence of stretches of strip of different thickness may be for example:

- first stretch of 1.0 mm of thickness weighting 20 metric tons,
- second stretch of 0.8 mm of thickness weighting 20 metric tons,
- third stretch of 0.6 mm of thickness weighting 20 metric tons,
- fourth stretch of 0.5 mm of thickness weighting 100 metric tons,
- fifth stretch of 0.6 mm of thickness weighting 10 metric tons,
- sixth stretch of 0.8 mm of thickness weighting 10 metric tons,
- and then back to a last stretch of strip which is 1.0 mm thick.

Advantageously, the first stretch is rolled to a thickness greater than 0.8 mm, so that it is easier to cut with the cutting means 13, preferably flying shears, and to lead in on the fly the head of the strip obtained on the accumulation means 20, e.g. on the reel 37.

At this point, the thickness at the outlet of the rolling stands 17 may be gradually reduced by seamlessly winding a mega coil from 3 to 6 meters in diameter and weight from 80 to 250 metric tons composed of lengths of strip of different thicknesses on the accumulation means 20. The last stretch of strip is rolled again to the thickness exceeding 0.8 mm so as to cut on the fly the head of the strip with the flying shears 13 and lead said head of the strip on the fly on the conventional winding systems 14.

In the example above, a 180-metric ton mega coil of strip with stretches of different thickness is wound on the accumulation means. The tail is locked by pinch roller 50 and deflector 51 placed before the winding reel 37.

The mega coil is fully wound onto the reel 37, with the first stretch and the last stretch of the strip thicker than 0.8 mm and with intermediate stretches of strip with a thickness less than or equal to 0.8 mm, is displaced by rotation of the rotatable platform 38 into the unwinding position. Once this position is reached, there will be a mega coil ready to be unwound from the reel 37 and a winding reel 37' in winding position, ready to begin a new winding sequence.

At this point, the mega coil starts being unwound from the reel 37 and introduced into a line of cutting and winding line 22, in which the stretches of strip of different thickness are divided into coils of specific weight from 10 to 20 kg/mm, whereby obtaining coils up to 35 metric tons, preferably from 15 to 35 metric tons of weight.

In an embodiment of the plant of the invention, the strip with stretches of different thickness is, in a first variant, further rolled in the reversible rolling stands 28 configured to maintain the difference of thickness in the various stretches of strip. This is obtained by adjusting on the fly the rolling set by means of the aforesaid automated adjustment devices to obtain the desired thickness for each stretch of strip. The stretches of strip further rolled to different thickness are identified and separated by means of the static cutting shears 29 or 29' and the corresponding coils of strip are wound on an appropriate winding and unloading station comprising respectively at least one reel 27 or at least one reel 26, according to whether the last rolling step is an odd step or an even step, respectively. Thickness gages are provided which detect the jump of thickness of the strip and an automatic command stops the portion of strip which includes the jump of thickness at the cutting shears 29 or 29', so that a portion of strip of equal thickness is wound on the reel 27 or 26, respectively, to form a coil.

In a further variant of the plant, the stretches of strip having different thickness constituting the mega coil are rolled in the stands 28 of the reversible rolling mill to a programmed specific thickness, which is instead equal for all stretches of strip. In this manner, instead, the thickness of the strip of the mega coil is uniformed again.

In both variants, the unwinding/winding speed of the accumulation means 20 and the cutting cycle and winding of the coils on the reels 26 or 27 will be sized in such a way that the cutting and winding line 22 has an hourly production rate which is either equal to or higher than the hourly production rate of the continuous casting machine which feeds the downstream rolling process.

In a process variant, the reversible rolling stands 28 are used to obtain a controlled hardening of the strip. Once the desired thickness is reached, the stands 28 are opened and the strip crosses these stands 28, without applying further reductions of thickness, there being activated only the rapid heating devices 23, 23' to take the material to a recrystallization temperature. Successively, the strip crosses these stands 28, without applying further reductions of thickness, there being activated only the rapid cooling devices 24, 24'.

A variant of the combined continuous casting and metal strip hot-rolling plant, instead, provides a "coil to coil" operation, in which the continuous casting slab is cut into pieces of slab, by the shears 2 or 7, to a size such that, at the end of the rolling process, by means of reductions in thickness only in the rolling mills 6 and 11, a coil of strip of the desired size directly wound on the winding reels 14 is obtained for each, piece of slab. In this variant, a rapid cooling device 9 is provided, which can be activated, when heating does not need to remain in austenitic range to enter into the finishing mill at temperature lower than the non-recrystallization temperature.

In this description, the rapid cooling devices 9, 16, 19 are, for example, devices for the production of blades or sprays of liquid on both the upper and lower surfaces of the strip, which may use pressurized liquid by means of nozzles or only by means of conveying holes.

The invention claimed is:

1. A combined continuous casting and endless rolling plant for a metal strip, comprising a continuous casting line for casting a slab;

a first rolling mill for roughing the slab and for obtaining a transfer bar;

a second rolling mill for finishing the transfer bar and for obtaining a strip;

accumulation means of the strip comprising at least one first high-capacity reel, dimensioned to wind and unwind a coil weighing from 80 to 250 metric tons and/or up to 6 meters in diameter, said coil being named mega coil;

characterized in that there are provided:

a third rolling mill, comprising at least two first rolling stands, for further reducing a thickness of the strip; said accumulation means of the strip being arranged downstream of said third rolling mill;

cutting means, arranged between said third rolling mill and said accumulation means, configured to cut the strip after the mega coil has been wound on the at least one first high-capacity reel;

a cutting and winding line, downstream of said accumulation means, for cutting the strip of the mega coil and winding portions of said strip of the mega coil up to a predetermined weight limit or coil diameter limit, producing a plurality of coils;

wherein said cutting and winding line is provided with a reversible rolling mill for performing at least one rolling of the strip before producing said plurality of coils.

2. The plant according to claim 1, wherein said cutting and winding line further comprises a second high-capacity reel, arranged downstream of said reversible rolling mill, for winding the strip after at least one odd step of rolling in the reversible rolling mill, said second high-capacity reel being dimensioned to wind a mega coil;

at least one distal intermediate reel, distal from the accumulation means and arranged between said reversible rolling mill and said second high-capacity reel, and dimensioned to wind at least one portion of the strip, after at least one odd step in the reversible rolling mill, up to a predetermined weight limit or coil diameter limit;

distal cutting means, distal from the accumulation means and arranged between said reversible rolling mill and said at least one distal intermediate reel, adapted to cut the strip whenever a portion of strip wound on the at least one distal intermediate reel reaches said predetermined weight limit or coil diameter limit;

at least one proximal intermediate reel, proximal to the accumulation means and arranged between said accumulation means and said reversible rolling mill, for winding at least one portion of the strip after at least one even step of rolling in the reversible rolling mill in a direction opposite to the odd step, said at least one proximal intermediate reel being dimensioned to wind strip portions up to said predetermined weight limit or coil diameter limit;

proximal cutting means, proximal to the accumulation means and arranged between said at least one proximal intermediate reel and said reversible rolling mill, and adapted to cut the rolled strip whenever a portion of strip wound on the at least one proximal intermediate reel reaches said predetermined weight limit or coil diameter limit.

3. The plant according to claim 2, wherein an inlet rapid heating device and/or an inlet rapid cooling device are provided between the accumulation means and the at least one proximal intermediate reel, and arranged at an inlet of the reversible rolling mill, and wherein an outlet rapid heating device and/or an outlet rapid cooling device are provided between the at least one distal intermediate reel and the second high-capacity reel, and arranged at an outlet of the reversible rolling mill.

4. The plant according to claim 2, wherein automated adjustment devices are provided to adjust a gap between working rolls of the first rolling stands of the third rolling mill and between working rolls of rolling stands of the reversible rolling mill, so as to produce stretches of strip of mutually different thickness.

5. The plant according to claim 4, wherein said automated adjustment devices comprise at least one strip thickness gage, adapted to detect jumps of strip thickness, and an automatic control system, cooperating with said at least one strip thickness gage and configured to stop a portion of strip, which includes a thickness jump, at the distal cutting means or at the proximal cutting means.

6. The plant according to claim 1, wherein the reversible rolling mill has at least two second rolling stands.

7. The plant according to claim 1, wherein a first rapid heating device and/or a first rapid cooling device are provided between the second rolling mill and the third rolling mill; said first rapid heating device being adapted to be activated if rolling is kept in austenitic range and said first rapid cooling device being adapted to be activated if the rolling is changed from austenitic range to ferritic range.

8. The plant according to claim 1, wherein said accumulation means comprise two first high-capacity reels integral with a rotatable platform, adapted to rotate about a vertical axis, so that, alternatively, one high-capacity reel of said two first high-capacity reels is used as a winding reel of the strip coming from the third rolling mill and the other high-capacity reel of said two first high-capacity reels is used as an unwinding reel of the strip to feed said strip towards said reversible rolling mill.

9. The plant according to claim 1, wherein a laminar cooling device is provided between the third rolling mill and the cutting means.

10. The plant according to claim 1, wherein at least two winding systems are provided arranged between the cutting means and the accumulation means.

11. A continuous casting and endless rolling process of metal strip, by means of a plant according to claim 1, comprising the following steps:

a) casting a slab by means of the continuous casting line;
b) roughing the slab to obtain a transfer bar by means of the first rolling mill;
c) finishing the transfer bar to obtain a strip by means of the second rolling mill;
d) further reducing the thickness of the strip by means of the at least two first rolling stands-of the third rolling mill;
e) winding the strip, by means of the at least one first high-capacity reel of the accumulation means, to form a coil weighing from 80 to 250 metric tons and/or up to 6 meters in diameter, named mega coil;
f) cutting the strip by means of the cutting means, once the mega coil has been wound on the at least one first high-capacity reel;
g) unwinding the strip from the at least one first high-capacity reel and performing at least one first rolling step of the strip in the reversible rolling mill;
h) cutting the strip and winding portions of said strip up to a predetermined weight limit or coil diameter limit, producing a plurality of coils.

12. The process according to claim 11, wherein if at least two odd steps and at least one even step of rolling are provided in the reversible rolling mill, the following are provided in steps g) and h):

i) unwinding the strip from the at least one first high-capacity reel and performing an odd rolling step in the reversible rolling mill up to wind the strip on a second high-capacity reel where the mega coil is made again;
ii) unwinding the strip from the second high-capacity reel and performing an even rolling step in the reversible rolling mill, in the direction opposite to the odd step, up to wind the strip on the at least one first high-capacity reel, on which the mega coil is made again;
iii) repeating step i) and possibly step ii) to reach at least a given thickness of the strip or of stretches of strip;

wherein if the last step of rolling is an odd step at an outlet of the reversible rolling mill, winding a portion of strip on at least one distal intermediate reel, distal from the accumulation means, up to said predetermined weight limit or to said predetermined coil diameter limit, defining a first coil;
cutting the strip after forming said first coil, by means of distal cutting means, distal from the accumulation means;
winding on said at least one distal intermediate reel further portions of strip up to said predetermined limit weight or coil diameter limit, defining further coils, by cutting the strip by means of said distal cutting means, after forming each of said further coils;

and wherein if the last step of rolling is an even step at the outlet of the reversible rolling mill, winding a portion of strip on at least one proximal intermediate reel, proximal to the accumulation means, up to said predetermined weight limit or coil diameter limit, defining a first coil;
cutting the strip after forming said first coil, by means of proximal cutting means, proximal to the accumulation means;
winding on said at least one proximal intermediate reel further portions of strip up to said predetermined weight limit or coil diameter limit, defining further coils, by cutting the strip by means of the proximal cutting means after forming each of said further coils.

13. The process according to claim 11, wherein if only one step of rolling is provided in the reversible rolling mill, the following are provided in steps g) and h):

unwinding the strip from the at least one first high-capacity reel and performing said step of rolling in the reversible rolling mill;
winding on at least one distal intermediate reel, distal from the accumulation means, a portion of strip up to said predetermined weight limit or said coil diameter limit, defining a first coil;
cutting the strip after forming said first coil, by means of distal cutting means, distal from the accumulation means;
winding on said at least one distal intermediate reel further portions of strip up to said predetermined weight limit or coil diameter limit, defining further coils, by cutting the strip by means of the distal cutting means after forming each of said further coils.

14. The process according to claim 11, wherein if only two steps of rolling are provided in the reversible rolling mill, the following are provided in steps g) and h):

unwinding the strip from the at least one first high-capacity reel and performing an odd rolling step in the reversible rolling mill up to wind the strip on a second high-capability reel on which the mega coil is made again;
unwinding the strip from the second high-capacity reel and performing an even step of rolling in the reversible rolling mill, in opposite sense to the odd step;
winding on at least one proximal intermediate reel, proximal to the accumulation means, a portion of strip up to said predetermined weight limit or said coil diameter limit, defining a first coil;
cutting the strip after forming said first coil, by means of proximal cutting means, proximal to the accumulation means;
winding on said at least one proximal intermediate reel further portions of strip up to said predetermined weight limit or coil diameter limit, defining further coils, by cutting the strip by means of the proximal cutting means after forming each of said further coils.

15. The process according to claim 11, wherein between step c) and step d), either a rapid heating is provided by means of a first rapid heating device to keep rolling in austenitic range or a rapid cooling is provided by means of a first rapid cooling device to pass from a rolling in austenitic range to a rolling in ferritic range.

16. The process according to claim 11, wherein, between step g) and step h), the second rolling stands of the reversible rolling mill are opened and the strip reversibly crosses said second rolling stands, without applying further reductions of thickness, being first heated by an inlet rapid heating device and an outlet rapid heating device, arranged respectively at an inlet and at an outlet of the reversible rolling mill, and then cooled by an inlet rapid cooling device and by an outlet rapid cooling device, arranged at the inlet and at the outlet of the reversible rolling mill, respectively.

17. The process according to claim 11, wherein if two first high-capacity reels are provided integral with a rotatable platform adapted to rotate about a vertical axis, after a first mega coil was wound on a high-capacity reel of said two first high-capacity reels, the rotatable platform rotates whereby the other high-capacity reel of said two first high-capacity reels is used as winding reel of the strip to make a second mega coil, while the high-capacity reel of said two first high-capacity reels is used as unwinding reel of the first mega coil to feed the reversible rolling mill, and so on.

18. The process according to claim 17, wherein a first hourly rate of the cutting and winding line is either equal to or greater than a second hourly rate of the continuous casting machine which feeds a downstream rolling in the first rolling mill, the second rolling mill and the third rolling mill.

19. The process according to claim 11, wherein said predetermined weight limit is up to 35 metric tons.

20. The process according to claim 11, wherein, in step d), making stretches of strip having mutually different thickness is provide.

* * * * *